US007669856B2

(12) United States Patent
Lemberg et al.

(10) Patent No.: US 7,669,856 B2
(45) Date of Patent: Mar. 2, 2010

(54) WAGERING GAME INVOLVING CARD RANGES

(75) Inventors: Joseph E. Lemberg, Bloomfield Hills, MI (US); Steven J. Lemberg, Bloomfield Hills, MI (US)

(73) Assignee: Avant-Garde Games, LLC, Bloomfield Hills, MI (US)

( * ) Notice: Subject to any disclaimer, the term of this patent is extended or adjusted under 35 U.S.C. 154(b) by 0 days.

(21) Appl. No.: 11/558,322

(22) Filed: Nov. 9, 2006

(65) Prior Publication Data

US 2007/0290443 A1 Dec. 20, 2007

Related U.S. Application Data

(63) Continuation-in-part of application No. 11/468,754, filed on Aug. 30, 2006.

(60) Provisional application No. 60/823,877, filed on Aug. 29, 2006, provisional application No. 60/864,793, filed on Nov. 8, 2006, provisional application No. 60/805,091, filed on Jun. 19, 2006.

(51) Int. Cl.
*A63F 1/00* (2006.01)
*A63F 3/08* (2006.01)

(52) U.S. Cl. ..... 273/292; 273/274

(58) Field of Classification Search ..... 273/292, 273/274

See application file for complete search history.

(56) References Cited

U.S. PATENT DOCUMENTS

| | | | | |
|---|---|---|---|---|
| 4,651,997 | A * | 3/1987 | Wood | 273/274 |
| 6,012,719 | A * | 1/2000 | Webb | 273/292 |
| 6,406,024 | B1 | 6/2002 | Perkins | |
| 6,457,715 | B1 * | 10/2002 | Friedman | 273/274 |
| 6,547,246 | B2 | 4/2003 | Webb | |
| 7,048,274 | B2 | 5/2006 | Duncombe et al. | |
| 2004/0070145 | A1 * | 4/2004 | Schlumbrecht | 273/292 |
| 2005/0051963 | A1 * | 3/2005 | Snow | 273/292 |
| 2005/0059448 | A1 | 3/2005 | Sims et al. | |
| 2006/0108735 | A1 | 5/2006 | Pastirik | |

OTHER PUBLICATIONS

Scarne, Yablon, Scarne's Encyclopedia of Games, 1974, p. 313, 1st edition, Harper & Row, USA.
Foxwoods Casino Acey Deucey.
Complete Guide to Red Dog Poker Casino Gambling.

* cited by examiner

*Primary Examiner*—Gene Kim
*Assistant Examiner*—Michael D Dennis
(74) *Attorney, Agent, or Firm*—Muskin & Cusick LLC

(57) ABSTRACT

A wagering game wherein a player is dealt a card and the dealer is dealt a card, and a player wins if a player's card and the dealer's card are of equal rank, or if a player is dealt a second card that falls in rank between a player's card and a dealer's card. The player is given an option to exchange his or her initial card. The player is also given an option to double his or her wager before his second card is dealt. A bonus round can also be offered wherein a bonus card is dealt and the player wins a bonus if the bonus card falls between the dealer's card and the player's second card.

2 Claims, 4 Drawing Sheets

WAGERING GAME INVOLVING CARD RANGES

CROSS REFERENCE TO RELATED APPLICATIONS

This application claims benefit of provisional application 60/823,877, filed Aug. 29, 2006, which is incorporated by reference herein in its entirety. This application also claims benefit of provisional application 60/864,793, filed Nov. 8, 2006, which is incorporated by reference herein in its entirety. This application is also a continuation in part of application Ser. No. 11/468,754, filed Aug. 30, 2006, which claims benefit of provisional application 60/805,091, filed Jun. 19, 2006, both which are incorporated by reference herein in their entireties.

BACKGROUND OF THE INVENTION

1. Field of the Invention

The present inventive concept relates to a wagering game intended for use in casinos.

2. Description of the Related Art

Acey-Deucey (also known as "In-Between" or "Yablon") is a gambling game which involves dealing two cards face up to a player, and then dealing a third card wherein the player wins if the third card falls between the player's first two cards. Please see Scarne's Encyclopedia of Games, first edition, 1973, page 313 ("Yablon"), which is incorporated by reference herein in its entirety.

While at least one variation of Acey-Deucey appeared in casinos and for a time proved entertaining to casino players, it has been nearly extinct for many years, largely because that variation was very simple and repetitive, involved no meaningful strategy yet moved too rapidly, causing players to lose interest quickly.

Therefore, what is needed is a more interesting version of Acey-Deucey which players will find more challenging, exciting, and appropriately-paced in order to maintain long-term player interest.

SUMMARY OF THE INVENTION

It is an aspect of the present invention to provide an exciting wagering game.

The above aspects can be obtained by a method that includes (a) receiving a wager from a player; (b) dealing a player's first card and a dealer's card; (c) offering the player an option to place a double wager equal in amount to the wager, and if the player wishes to place the double wager then receiving the double wager from the player; (d) dealing a player's second card; and (e) determining if the player's second card falls between the player's first card and the dealer's card, and if so, then (resolving the wager in the player's favor and if the double wager was placed then resolving the double wager in the player's favor as well).

The above aspects can also be obtained by a method that includes (a) receiving a wager from a player; (b) dealing a player's first card and a dealer's card; (c) dealing a player's second card; (d) determining if the player's second card falls between the player's first card and the dealer's card, and if so, then the player wins a payout on the wager; (e) dealing a bonus card; and (f) determining if the bonus card falls between the dealer's card and the player's second card, and if so, then paying the player a bonus.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
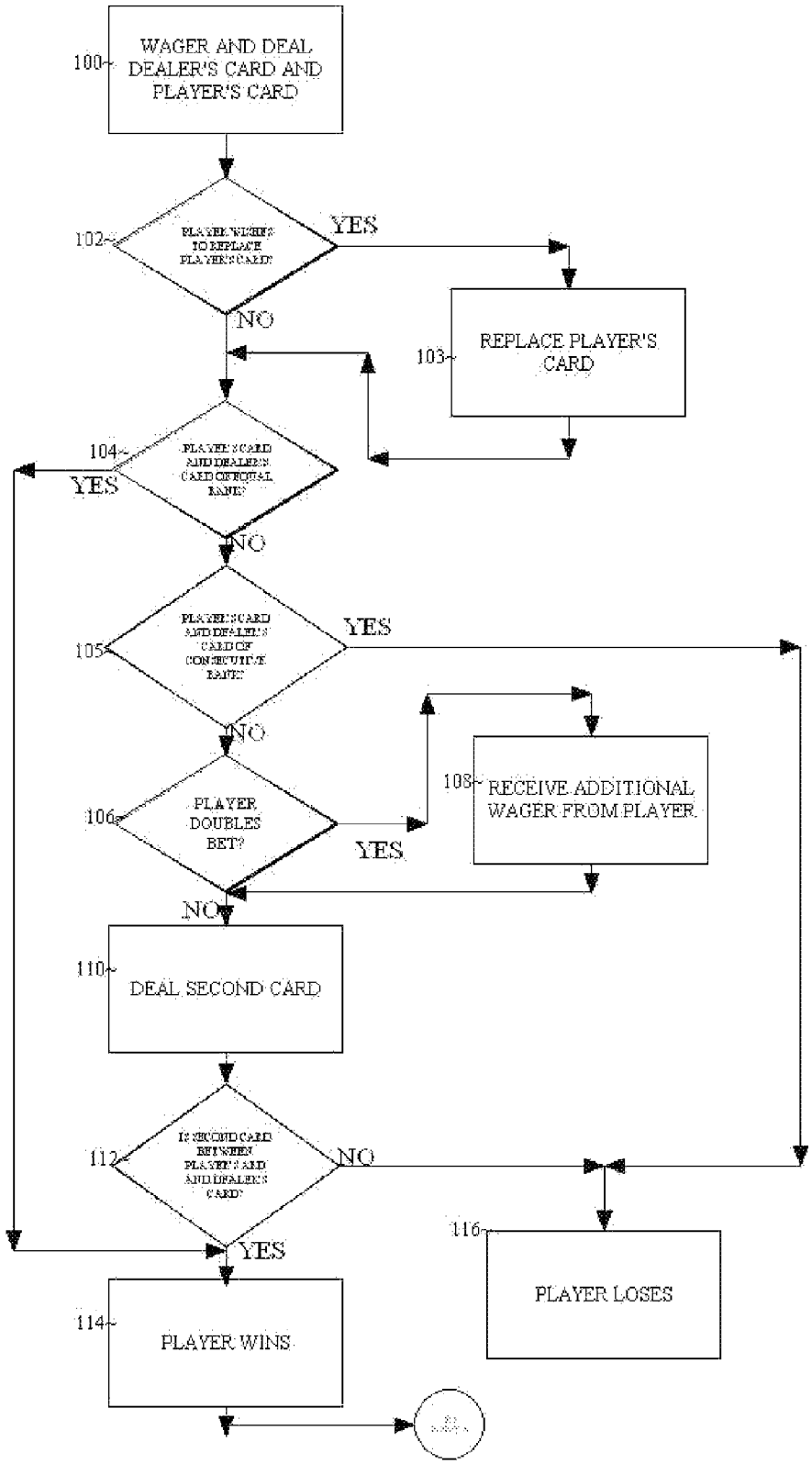
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer an exciting wagering game, wherein the player benefits when dealt cards fall between two other cards.

The game is played as follows. A player makes a wager. The player is dealt a card and the dealer is dealt a card. If the player wishes to replace his or her card, he can do so a maximum of one time. The player then has an option to double (or increase without necessarily doubling) the wager by placing a double wager. The player is dealt a second card, wherein if the second card falls between the player's card and the dealer's card, then the player wins a payout (e.g., even money) on the wager. If the player placed a double wager (he was not required to do so, but could do so at his or her option), then the player also wins a payout (e.g., even money) on the double wager as well.

The game also incorporates a bonus round, wherein a bonus card is dealt, and if the bonus card falls between the player's second card and the dealer's card, then the player wins a bonus payout. The player is not required to make a wager to play or win in the bonus payout.

FIG. 1 is a flowchart illustrating an exemplary method of implementing a wagering game, according to an embodiment.

The method can begin with operation 100, which receives a wager from the player and then deals a player's card and a dealer's card. This can be done in any order. The wager can be considered an initial wager.

From operation 100, the method can proceed to operation 102, which determines whether the player wishes to replace the player's card. For example, if the gap between the player's card and the dealer's card is small, then the player may wish to replace the player's card in order to increase the gap, and hence increase his or her chances of winning. If the player wishes to replace the player's card, then the method can proceed to operation 103, which replaces the player's card. This can be done by the player indicating (e.g., by speaking or hand signal) to the dealer that he or she wishes to replace the player's card, and the dealer can deal another card to the player which replaces the player's card dealt in operation 100. If the player does not wish to replace the player's card dealt in operation 100, then he can indicate as such and the method can proceed to operation 104.

From either operation 102 or operation 103, the method can then proceed to operation 104, which determines if the player's card and the dealer's card are of equal rank. If they are, then the method proceeds to operation 114, wherein the player wins. In this situation, the player does not qualify for the bonus round (although in an alternative embodiment if the player's card and the dealer's card are of equal rank the player would qualify for the bonus round). In an alternative embodiment, if the player's card equals the dealer's card then the player automatically loses.

If the determination in operation 104 determines that the player's card and the dealer's card are not of equal rank, then the method can proceed to operation 105, which determines whether the player's card and the dealer's card are of consecutive rank. If they are, then the method proceeds to operation 116 wherein the player loses.

If the determination in operation 105 determines that the player's card and the dealer's card are not of consecutive rank, then the method can proceed to operation 106, which determines whether the player decides whether to double his or her bet. Note that the player may (depending on the house rules) be allowed to increase his or her bet at an amount less than the wager up to an amount equal to the wager (doubling). If the player wishes to double his or her bet, then the method can proceed to operation 108, which receives an additional wager (a double wager) from the player. The player can place an additional wager by placing a double wager on the table alongside his or her wager. If the player does not wish to double his or her bet, then from operation 106 the method can proceed to operation 110.

If the player, in operation 100, has an automatically losing hand, the player is still free to replace the player's card in operation 103.

From either operation 106 or operation 108, the method can proceed to operation 110, which deals a second card.

From operation 110, the method can proceed to operation 112, which determines whether the second card falls between the player's card and the dealer's card. For example, if the player's card is a two and the dealer's card is a ten, and the second card is a seven, then the seven falls between the two and the ten. It is noted that if the player chose to replace the player's card in operation 103, then the player's card refers to the more recent player's card and not the original player's card dealt in operation 100. Typically, suits do not matter. A card (A) falls between two cards (B, C) if A has a rank greater than the lowest rank of (B, C) and A has a rank less than the highest rank of (B, C). If A equals B or C, then A does not fall between B and C. Although in an alternative embodiment, if A equals B or C, then A is considered to fall between B and C.

If the determination in operation 112 determines that the player's second card does not fall between the player's card and the dealer's card, then the method can proceed to operation 116, wherein the player loses. The player's wager, and any double wager placed, will be collected by the house.

If the determination in operation 112 determines that the second card does fall between the player's card and the dealer's card, then the player wins. The player's wager as well as his or her double wager (if made) can be paid. The method can then proceed to point B of FIG. 2, in order to implement the bonus round.

Figure 2:
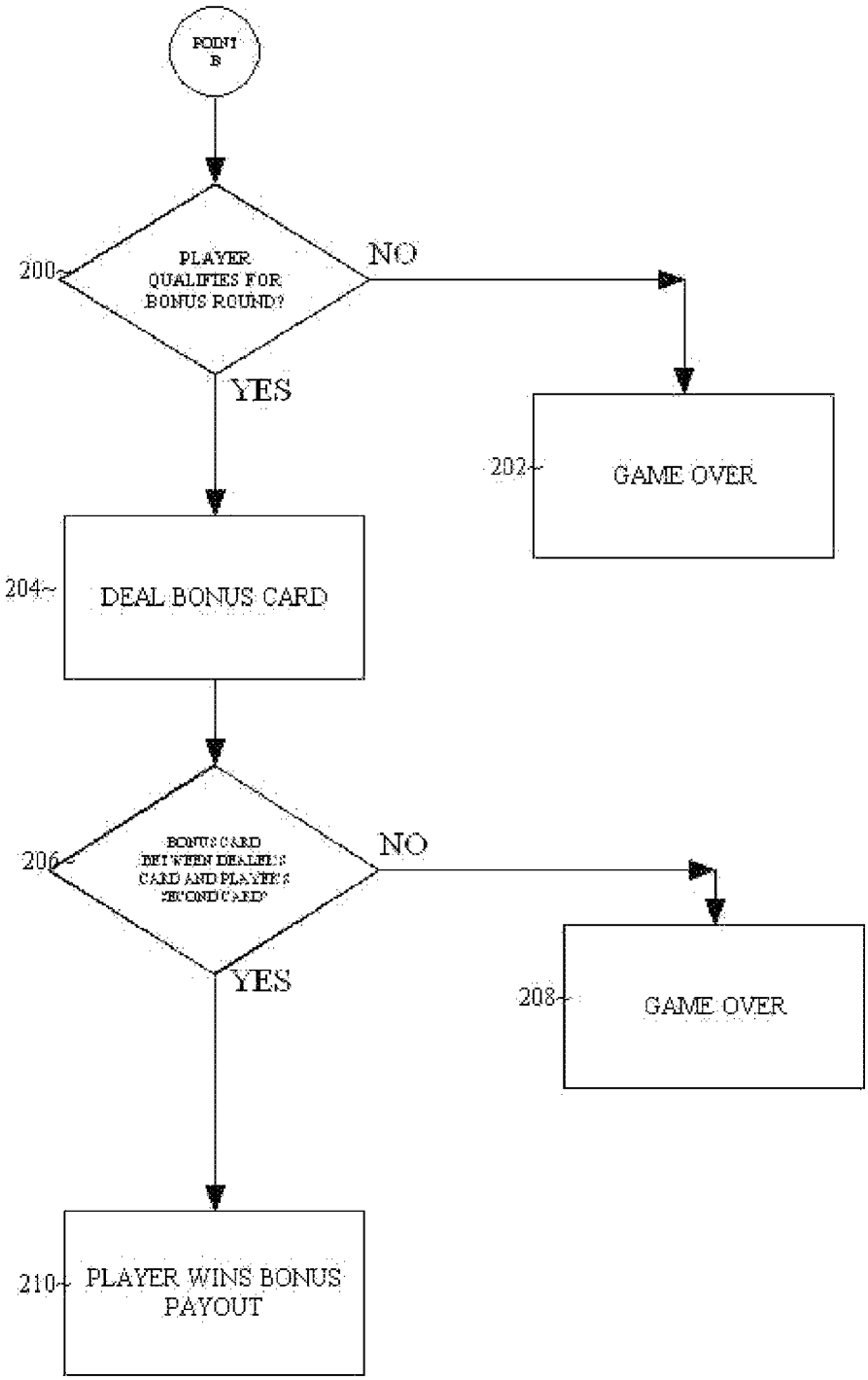
FIG. 2 is a flowchart illustrating an exemplary method of implementing a bonus payoff for a wagering game, according to an embodiment.

FIG. 2 is a flowchart illustrating an exemplary method of implementing a bonus round of a wagering game, according to an embodiment.

The bonus round can be implemented when all players at the table have completed their hands. In operation 200, it is determined whether the player qualifies for the bonus round. If the determination is that the player does not qualify for the bonus round, then the method proceeds to operation 202, wherein the game is over. The player qualifies for the bonus round, in addition to winning his or her wager, if there is at least one possible rank of card between the player's second card and the dealer's card. If the player's second card and the dealer's card are of consecutive rank, then the player does not qualify for the bonus round.

If the determination in operation 200 determines that the player qualifies for the bonus round, then the method can proceed to operation 204, which deals a bonus card. The bonus card can be a common card for the entire table.

From operation 204, the method can proceed to operation 206, which determines whether the bonus card falls between the dealer's card and the player's second card. Note that in an alternative embodiment, any two dealt cards can be used besides the dealer's card and the player's second card. For example, the player's second card and the player's card can be used, or any other two cards.

If the determination in operation 204 determines that the bonus card does not fall between the two cards (e.g., the player's second card and the dealer's card), then the method proceeds to operation 208, wherein the game is over.

If the determination in operation 206 determines that the bonus card does fall between the two cards (e.g., the player's second card and the dealer's card), then the method proceeds to operation 210 wherein the player wins a bonus payout. The payout in operation 210 is typically "free," that is, the player did not have to make an additional bet in order to win this payout.

An example of the game will now be presented in FIGS. 3B to 3E. It is noted that these figures illustrate a table that can accommodate three simultaneous players, although of course any number of players can be accommodated. In this example, two players will be playing simultaneously.

Figure 3A:
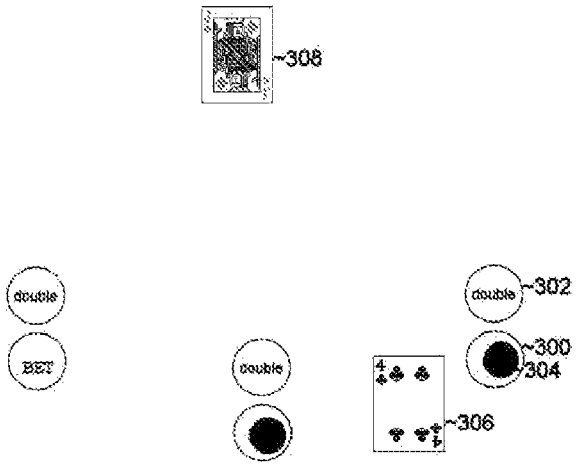
FIG. 3A is a drawing of a first stage of an example game, according to an embodiment.

FIG. 3A is a drawing of a first stage of an example game, according to an embodiment.

Player 2 (in the middle seat) and player 3 (in the right seat) are playing. Player 2 puts a $1 chip in the "bet" betting circle. Player 3 puts a $5 chip 304 in his respective "bet" betting circle 300. There is also a respective double wager betting circle 302. The dealer then deals the player his card, a four of clubs. The dealer then deals the dealer's card, a jack of diamonds. Note the cards can be dealt in any order.

Figure 3B:
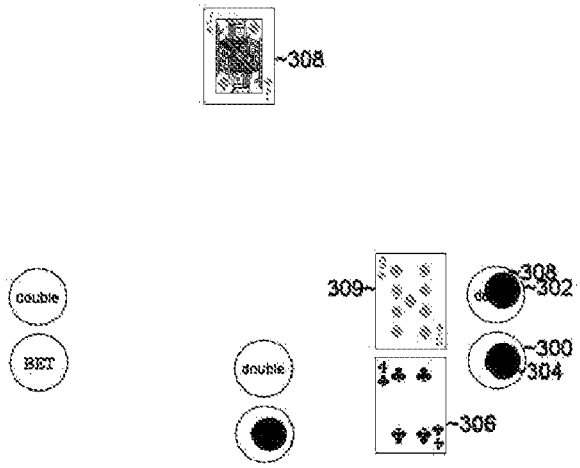
FIG. 3B is a drawing of a first stage of an example game, according to an embodiment.

FIG. 3B is a drawing of a first stage of an example game, according to an embodiment.

Player three decides to double, and places a second $5 chip 308 in the double wager betting circle. The dealer then deals a round one card 309 to player three, which is a nine of diamonds. Since the nine of diamonds falls between the four of clubs and the jack of diamonds, player 3 wins. The house will pay (not pictured) player 3 even money (although another payout can be used) on both player 3's initial wager 304 and his double wager 308. Thus, player three has won $10. The dealer can pay the player at any time (e.g., now or after the bonus card is dealt).

Figure 3C:
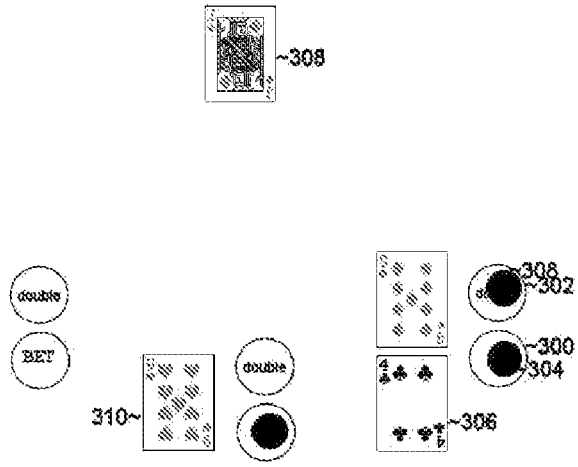
FIG. 3C is a drawing of a first stage of an example game, according to an embodiment.

FIG. 3C is a drawing of a first stage of an example game, according to an embodiment.

Now, the dealer proceeds to resolve the next player's (player two) hand. The dealer deals player 2's player's card, which is a nine of hearts.

Figure 3D:
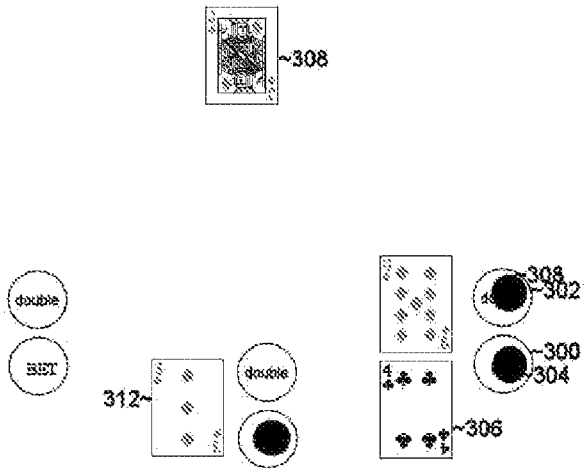
FIG. 3D is a drawing of a first stage of an example game, according to an embodiment.

FIG. 3D is a drawing of a first stage of an example game, according to an embodiment.

Figure 3E:
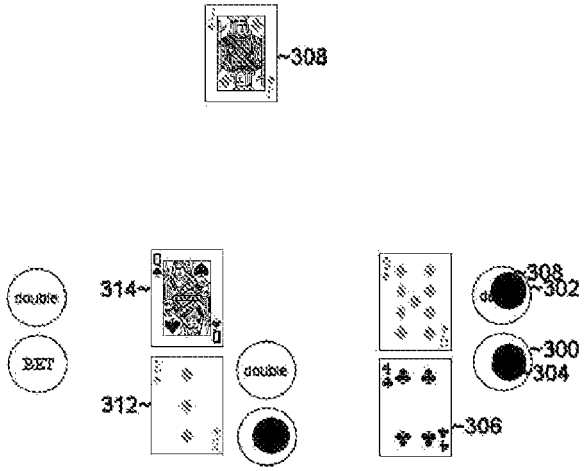
FIG. 3E is a drawing of a first stage of an example game, according to an embodiment.

Player two would not be happy with her card. This is because there is only one value (ten) that falls between a nine and a jack, which means the chances of getting a card to fall between those two cards is unlikely. So player two rightfully decides to replace player two's player's card and is now dealt a replacement player two's player's card 312, a three of diamonds. Player two does not decide to double;

FIG. 3E is a drawing of a first stage of an example game, according to an embodiment.

The dealer then deals player 2's second card 314, a queen of spades. Since the queen does not fall between the three and the jack, player two loses her wager ($1), although player two is happy that she decided not to double because had she done so, she would have lost more money.

Since all active players at the table have now finished their hands, it is time to play the bonus round. Only players who have won their wagers are eligible for the bonus round. In an alternative embodiment, players who have lost (or tied) their wagers can be eligible for the bonus round as well.

Figure 3F:
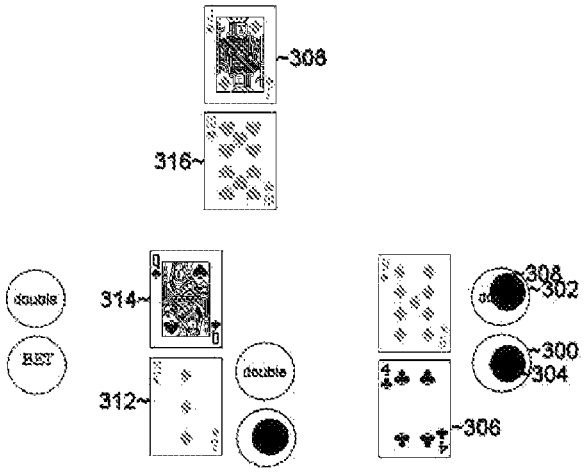
FIG. 3F is a drawing of a first stage of an example game, according to an embodiment.

FIG. 3F is a drawing of a first stage of an example game, according to an embodiment.

The dealer deals a bonus card, which can be a community card (e.g., this card applies to all live players in the bonus round). The bonus card 316 is a ten of hearts. Since the ten falls between the player 3's second card 308 (nine of diamonds) and the dealer's card (jack of diamonds), player 3 wins the bonus round. Player 3 can win a bonus payout, such as additional 1 to 2 on the wager ($2.50), and an additional 1 to 2 on the double, or 3 to 2 overall on her wager. Thus, player 3 has now won $15.00 from the current game and this game is now fully completed. In this embodiment, since player 2 lost her wager she is not eligible for the bonus round.

Of course, the order of operations illustrated in FIGS. 3A to 3F is exemplary, and the cards can be dealt in other orders/manners as well.

Table I below illustrates two sample paytables that can be used with methods described herein. For these payouts, if the player's card equals the dealer's card, the player automatically wins ("Winning Pair").

TABLE I

| Event | paytable 1 | paytable 2 |
|---|---|---|
| Winning Hand | even money | even money |
| Winning Pair | 1:2 | 1:2 |
| Win With Bonus | 3:2 | 8:5 |

Thus, for example, on both paytables, the wager and the double wager pay even money. If the player gets a winning pair (e.g. both the player's card and the dealer's card have the same rank, for example, both cards are a three) then both paytables pay 1:2. On paytable 1, if the player wins the bonus round (e.g., the bonus card falls between the player's second card and the dealer's card), then this pays 3:2 of the wager, while on paytable 2, this pays 8:5 of the wager.

There are a number of other possible variations or features that may be employed in this game. These may be employed separately or in conjunction with one another. Some of these may be employed in addition to the game as described, or instead of certain elements of the game as described. Following are these variations or features:

The bonus round can be converted from a risk-free proposition (as described above) to one where each player qualifying has the option of playing or not playing the bonus round, and where those players playing the bonus round will risk some or all of their bet and initial win if they lose the Bonus Round.

In a further embodiment, players could be allowed to place an additional wager in the bonus round before they see the bonus card.

In a further embodiment, additional rounds beyond the single bonus round can be implemented. This could be accomplished by allowing successive additional rounds (e.g. bonus round I, bonus round II, bonus round III, etc.) where to win the each additional round that round's card would need to be of a rank between the player's second card and the immediately prior dealer card (e.g. bonus card, then bonus card II, then bonus card III, etc.).

In a further embodiment, a separate bonus card can be dealt to each player instead of using a common community bonus card.

In a further variation, a progressive jackpot could also be adapted to the present wagering game if desired. One possible manner to effectuate a progressive jackpot would be through the use of additional Bonus Rounds as described above. The use of a progressive jackpot could be effectuated in other alternative ways. A progressive bet could be placed along with the initial wager which feeds a progressive jackpot meter, and certain hands could allow the player to win the progressive (e.g., the player's first and second cards are an ace and the dealer's card is an ace).

In a further embodiment, when a dealer card and a player card of equal rank, this can be handled differently than as illustrated in FIG. 1. For example, instead of it being a winning hand when the dealer card and the player's first card are of equal rank, when the dealer card and the player's first card are of equal rank the hand continues with the player automatically receiving a new player's first card in place of the player's first card of equal rank to the dealer card.

Alternatively, when the dealer's card and the player's first card are of equal rank, this can result in a push on the initial wager (and optionally any double wager placed as well).

Alternatively, when the dealer's card and the player's first card are of equal rank, the player is dealt a second card and if that second card is equal in rank to both the dealer's card and the player's card, then the player wins an amount in excess of a normal winning hand (e.g., double).

In yet additional embodiments, when the dealer's card and the player's first card are of successive rank, instead of this being an automatic loser for the player, this can result in a push on the initial wager (and optionally any double wager placed as well).

In a further embodiment, when the dealer's card and the player's first card are of successive rank, then the player can automatically replace his or her card.

In further embodiments, an ace can be played as high (higher than all other ranks), low (lower than all other rank), or can be played as both (at either the player's choice or the dealer's choice).

In yet more embodiments, additional payoffs can be implemented. For example, if certain poker hands are formed from some combination comprising any combination of the player's first card and/or the player's second card and/or the dealer's card and/or the bonus card. For example, a flush, straight, three of a kind, etc., can be paid according to a paytable. Optionally, payoffs for the game can be increased for certain winning hand containing cards of the same suit.

In yet a further embodiment, side bets can be permitted, such as for poker hands (e.g., pairs, straights, flushes, three of a kind, straight flushes, etc.), as determined by some combination of the player's first card and/or the player's second card and/or the dealer's card and/or the bonus card.

In a further additional embodiment, the player's second card can be a common (community card) used by all players. In this embodiment, then all eligible players will win or lose the final round together as the second card, bonus card, and the dealer card, will all be common cards.

Moreover, the game can be played with special decks which can include jokers or other wilds cards where the wild cards can be afforded a rank as chosen by the player.

Additionally, players could be permitted to play multiple hands on each deal, and such multiple hands could produce certain winning situations that are either determined independent of the other hands or in conjunction with the other hands.

In yet another embodiment, instead of the player doubling his bet in operation 106, the player can more than double his bet (e.g., triple his or her bet).

In yet a further embodiment, the game can be played without the bonus round.

It is further noted that the game (any variation described herein) can be implemented by an electronic gaming machine (EGM). It can also be played with multiple hands, for example, a player can play five hands simultaneously at one coin (or other amount) bet on each hand. With multiple hands being played there can be a common second card applying to all five (or any number) of hands, or each hand can get a separate second card. The slot machine/electronic device can have payoffs or bonus payoffs based on the number of wins and the number of bonus wins. For example, if playing five coins, the best outcome would be five bonus wins, and there could be lesser payoffs for fewer bonus wins. The slot machine/electronic version could include suited payoffs, straight payoffs and other poker hand payoffs. There could be a progressive jackpot based, for example, on winning all five hands with bonus, or possibly with some other requirements.

Any embodiments described herein can be played with a standard deck of cards or any type of special deck (e.g. a Spanish deck, etc.) The game can also be played with a single deck or multiple decks (e.g. 1-8 decks or more). Cards can be dealt in any order. Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to player a wagering game, the method comprising:

providing a physical deck(s) of card:

receiving a wager from a plurality of players;

dealing, from the deck(s) of cards, each player's first card face up, and a single dealer's card face up;

before each player's second card is dealt, offering the player an option to replace the player's first card, but not the dealer's card, and if the player wishes to replace the player's first card then replacing the player's first card, offering each player an option to place a double wager, and if each player wishes to place the double wager then receiving the double wager from the respective player;

dealing each player's second card;

determining if each player's second card falls between each player's first card and the dealer's card, and if so, then paying out the wager to the respective player; and if each player's second card falls between the respective player's first card and the dealer's card and the double wager was placed, then paying out the double wager to the respective player, determining if each player qualifies for the bonus round by determining if the respective player's second card falls between the respective player's first card and the dealer's card and if there is at least one rank of card between the respective player's second card and the dealer's card, and if both conditions are true, then dealing a bonus card without requiring an additional wager from the respective player; and determining if the bonus card falls between the dealer's card and the respective player's second card, and if so, then paying the respective player a bonus.

2. The method as recited in claim 1, wherein when the player's card equals in rank to the dealer's card, then the player automatically wins.

* * * * *